US006851555B1

(12) United States Patent
Ghafourian et al.

(10) Patent No.: US 6,851,555 B1
(45) Date of Patent: Feb. 8, 2005

(54) STACKABLE PALLET BRACKET, PACKAGE, AND METHOD

(75) Inventors: Ali A. Ghafourian, Atlanta, GA (US); Clinton D. Thornton, Dyersburg, TN (US)

(73) Assignee: ERMCO, Dyersburg, TN (US)

( * ) Notice: Subject to any disclaimer, the term of this patent is extended or adjusted under 35 U.S.C. 154(b) by 0 days.

(21) Appl. No.: 10/096,729

(22) Filed: Mar. 13, 2002

(51) Int. Cl.[7] ..... B65D 21/00
(52) U.S. Cl. ..... 206/386; 206/503; 414/802
(58) Field of Search ..... 108/26, 53.1, 53.5; 206/386, 597, 600, 503, 504, 821; 248/646, 675, 674; 414/802

(56) References Cited

U.S. PATENT DOCUMENTS

| | | | | | |
|---|---|---|---|---|---|
| 2,965,276 | A | | 12/1960 | Foster | 229/23 |
| 3,009,674 | A | * | 11/1961 | Ingvartsen | 108/14 |
| 3,944,073 | A | * | 3/1976 | Downing | 206/503 |
| 4,619,365 | A | * | 10/1986 | Kelly et al. | 206/503 |
| 4,779,751 | A | * | 10/1988 | Munroe | 217/69 |
| 4,804,087 | A | | 2/1989 | Smith | 206/335 |
| 5,036,979 | A | * | 8/1991 | Selz | 206/512 |
| 5,390,789 | A | * | 2/1995 | Darby | 206/391 |
| 5,413,224 | A | | 5/1995 | Marron et al. | 206/600 |
| 5,531,326 | A | * | 7/1996 | Hummel et al. | 206/509 |
| 5,680,948 | A | | 10/1997 | Schmidt et al. | 220/7 |
| 5,772,026 | A | | 6/1998 | Grigsby | 206/335 |
| 5,938,037 | A | | 8/1999 | Essary | 206/600 |
| 6,024,223 | A | | 2/2000 | Ritter | 206/600 |

* cited by examiner

*Primary Examiner*—Jim Foster
(74) *Attorney, Agent, or Firm*—Walker, McKenzie & Walker, P.C.

(57) ABSTRACT

A piggy back shipping/storage package, a bracket for use in building the package, and method for building the package. The bracket has an article attachment lug for being attached to the top of a lower article mounted on a lower pallet, and a pallet supporting platform for supporting the bottom of an upper pallet on which an upper article is supported.

2 Claims, 6 Drawing Sheets

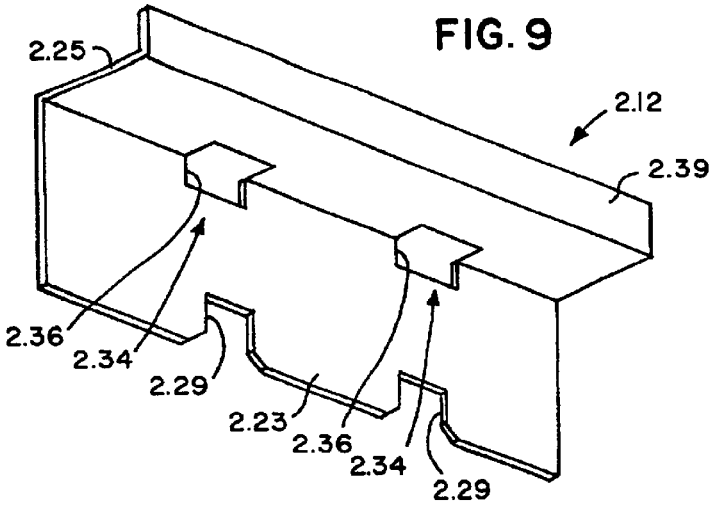
FIG. 9
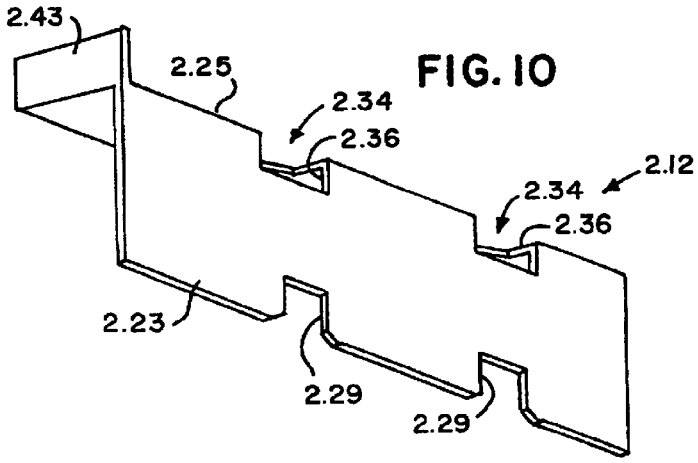
FIG. 10
FIG. 11
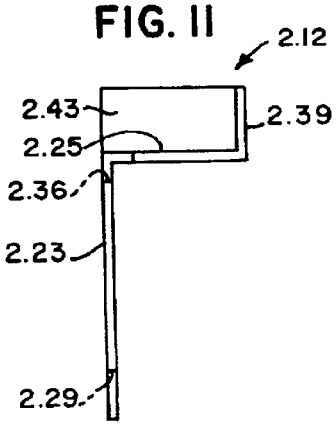
FIG. 12
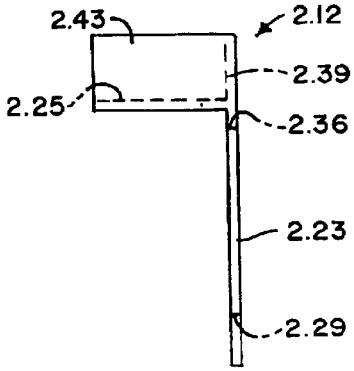

STACKABLE PALLET BRACKET, PACKAGE, AND METHOD

BACKGROUND OF THE INVENTION

1. Field of the Invention

The present invention relates, in general, to transformer shipping/storage packages, and in particular, to a bracket for mounting to the top of a lower article (i.e., a lower transformer) to hold a pallet for supporting an upper article (i.e., an upper transformer) in piggy back fashion over the lower article, the shipping/storage package formed thereby, and the method of forming that shipping/storage package.

2. Information Disclosure Statement

Transformers are normally shipped on a trailer on one level. The most common practice in the transformer industry is to ship and in store each transformer on an individual pallet. The floor space on the trailer then typically becomes the limiting factor as to how many transformers may be loaded on a trailer. Transformers may not be stacked directly one upon another for shipping or storage because damage may occur. Some trailers are equipped with decking capability where a second floor is constructed to support an upper deck of transformers. This requires specially equipped enclosed trailers. However, if shipping is to be done on flat bed trailers, the floor space is the limiting factor on how many transformers may be loaded on the trailer.

A preliminary patentability search in Class 206, subclasses 600 and 386, and in Class 220; subclass 1.5, produced the following patents which appear to be relevant to the present invention: Foster, U.S. Pat. No. 2,965,276, issued Apr. 24, 1957; Smith, U.S. Pat. No. 4,804,807, issued Feb. 14, 1989; Marron et al., U.S. Pat. No. 5,413,224, issued May 9, 1995; Schmidt et al., U.S. Pat. No. 5,680,948, issued Oct. 28, 1997; Grigsby, U.S. Pat. No. 5,772,026, issued Jun. 30, 1998; Essary, U.S. Pat. No. 5,938,037, issued Aug. 17, 1999; and Ritter, U.S. Pat. No. 6,024,223, issued Feb. 15, 2000.

None of these references, either singly or in combination, disclose or suggest the present invention. More specifically, nothing in the known prior art discloses or suggests a bracket having a lower article attachment lug for being attached to a lower article (i.e., a lower transformer) and having an upper pallet supporting platform for supporting the pallet of a upper pallet supported article (i.e., an upper transformer) in piggy back fashion over the lower article, the shipping/storage package formed thereby, and the method of forming that shipping/storage package.

BRIEF SUMMARY OF THE INVENTION

The present invention provides a bracket for mounting to the top of a lower article (i.e., a lower transformer) to hold a pallet for supporting an upper article (i.e., an upper transformer) in piggy back fashion over the lower article, the shipping/storage package formed thereby, and the method of forming that shipping/storage package. A basic concept of the present invention is to provide means which allows two articles to be stacked on pallets directly one upon the other to conserve space during shipping and storage and without damage to either article.

One object of the present invention is to provide a unique packaging design to stack two or more articles (i.e., transformers) for shipping and storage in a method that allows manufacturer and end user to reduce the cost of shipping and storage.

Another object of the present invention is to provide a bracket assembly which allows stacking two or more articles (i.e., transformers) without requiring any change in the present pallet assembly.

Another object of the present invention is to provide stackable pallet packaging which utilizes the lifting provisions of a lower articles (i.e., transformers) to support a frame on which an upper articles (i.e., transformers) rests, thus providing a sturdy shipping and storage package.

Another object of the present invention is to enable the stacking of articles (i.e., pad mounted transformers) on any type trailer without any special equipment.

BRIEF DESCRIPTION OF THE SEVERAL VIEWS OF THE DRAWINGS

FIG. 9 is a first side perspective view of a second embodiment of a bracket of the present invention.

FIG. 10 is a second side perspective view of the bracket of FIG. 9.

FIG. 11 is a first end elevational view of the bracket of FIG. 9.

FIG. 12 is a second end elevational view of the bracket of FIG. 9.

DETAILED DESCRIPTION OF THE INVENTION

Figure 1:
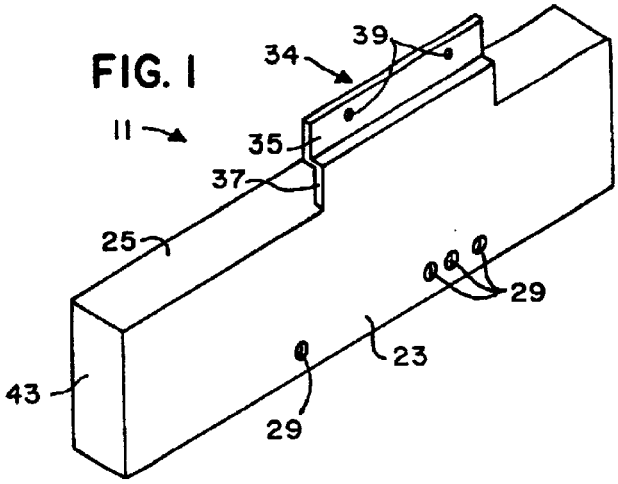
FIG. 1 is a first end perspective view of a first embodiment of a bracket of the present invention.
Figure 2:
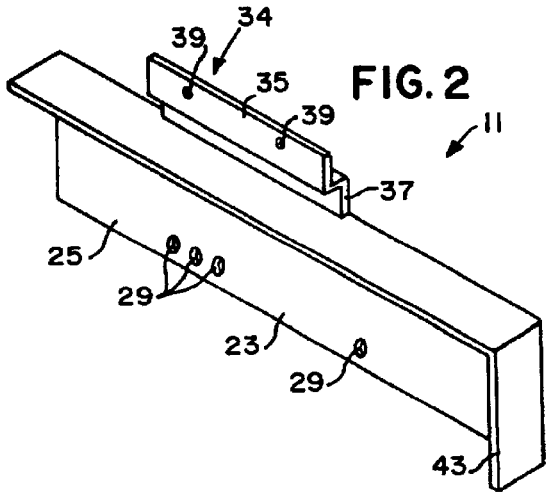
FIG. 2 is a second end perspective view of the bracket of FIG. 1.
Figure 3:
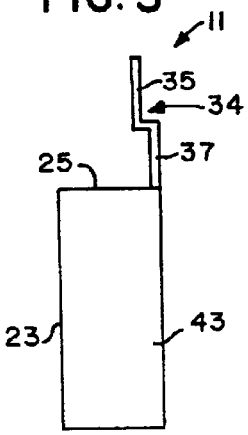
FIG. 3 is a first end elevational view of the bracket of FIG. 1.
Figure 4:
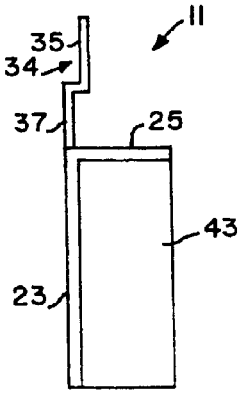
FIG. 4 is a second end elevational view of the bracket of FIG. 1.
Figure 5:
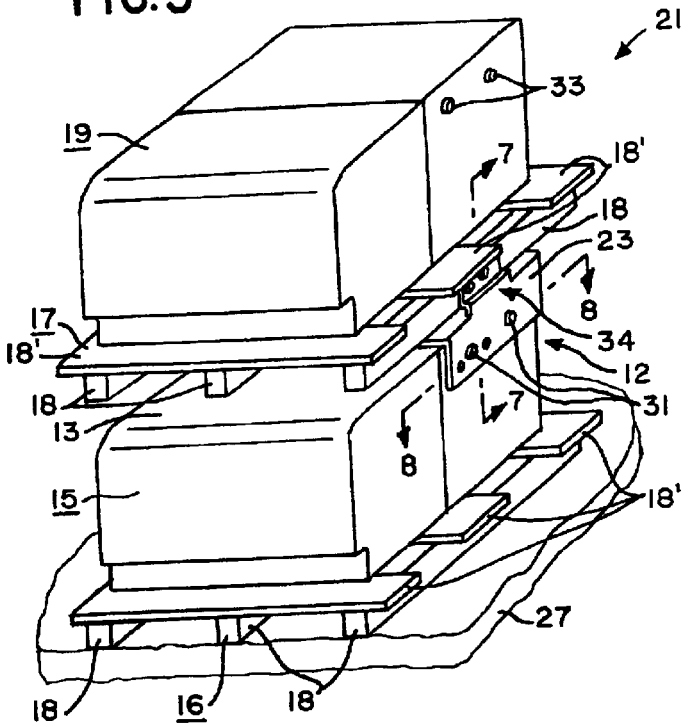
FIG. 5 is a right side perspective view of a shipping/storage package of the present invention, shown in combination with the first embodiment of the bracket of the present invention.
Figure 6:
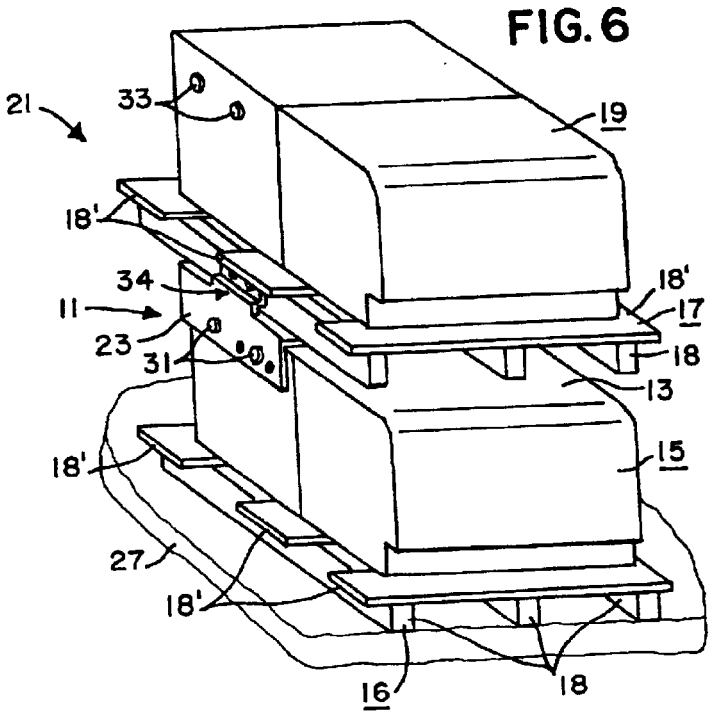
FIG. 6 is a left side perspective view of the shipping/storage package of FIG. 5.
Figure 7:
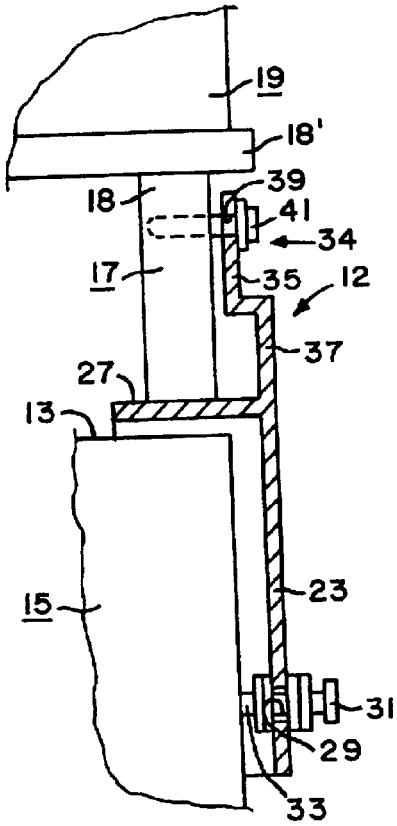
FIG. 7 is a sectional view substantially as taken on line 7—7 of FIG. 5 on an enlarged scale and with portions omitted or broken away for clarity.
Figure 8:
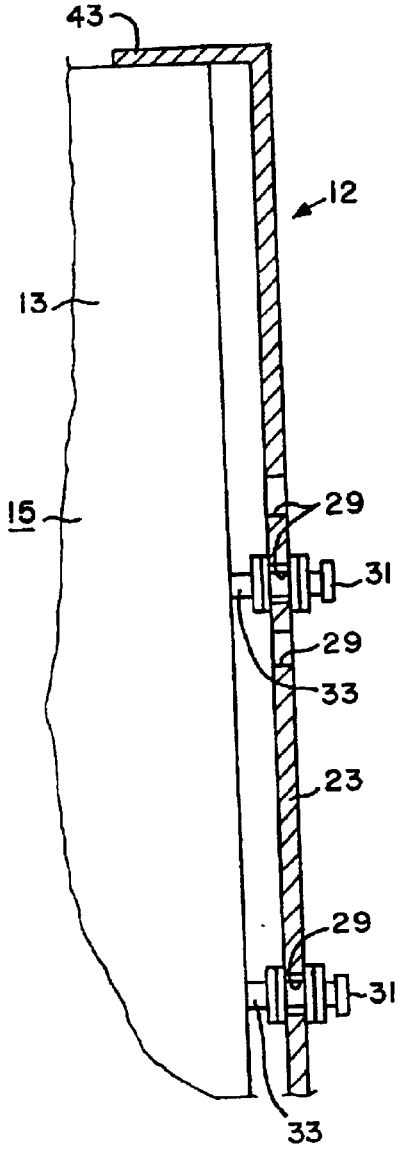
FIG. 8 is a sectional view substantially as taken on line 8—8 of FIG. 5 on an enlarged scale and with portions omitted or broken away for clarity.

The present invention includes a bracket for mounting to the top of a lower article (i.e., a lower pad mounted transformer or the like mounted on a lower pallet) to hold an upper pallet for supporting an upper article (i.e., an upper pad mounted transformer or the like mounted on the upper pallet) in piggy back fashion over the lower transformer and lower pallet; includes a shipping/storage package formed by mounting the upper pallet supporting the upper transformer above the top of the lower transformer in piggy back fashion; and includes a method of building that shipping/storage package.

A first preferred embodiment of the present invention, shown in FIGS. 1–8, includes a first or left hand bracket 11 and a second or right hand bracket 12 attached to opposite sides of the top 13 of a lower pad mounted transformer 15 mounted on a lower pallet 16, to hold an upper pallet 17 for supporting an upper pad mounted transformer 19 in piggy back fashion over the lower transformer 15 and lower pallet 16; and includes a shipping/storage package 21 formed by using the brackets 11, 12 to mount the upper pallet 17 and upper transformer 19 above the lower pallet 16 and lower transformer 15.

The pallets 16, 17 may consist of typical wood pallets on which goods are placed for storage or moving. Such typical wood pallets may include a plurality of elongated stringer beams 18, and a top deck comprised of one or more panels or boards 18' 9 supported on the stringer beams 18.

Each bracket 11, 12 is preferably a mirror image of one another, with one (i.e., the bracket 11) designed for mounting to the left side of the top 13 of the lower transformer 15 and with the other (i.e., the bracket 12) designed for mounting to the right side of the top 13 of the lower transformer 15. The following detailed description of the bracket 11 will be sufficient to disclose the structure, manufacture and operation of both brackets 11, 12 to those skilled in the art, with reference numerals to like elements and parts of each bracket 11, 12 being the same to emphasize the similarity of the two brackets 11, 12.

The bracket 11 includes a lower transformer attachment lug 23 for being attached to the lower transformer 15, and an upper pallet supporting platform 25 for supporting the upper pallet 17. Both the lower transformer attachment lug 23 and the upper pallet supporting platform 25 may be in the shape of generally rectangular plates attached to one another at one edge in a substantially 90° corner, forming a generally upside down L-shape structural member when viewed in cross section. When the lower transformer attachment lug 23 is attached to a lower transformer 15 supported on a lower pallet 16 resting on a typically horizontal support surface 27 (e.g., the ground, floor, trailer, etc.), the upper pallet supporting platform 25 forms a generally horizontally oriented plate for supporting one side of the bottom of the upper pallet 17 while the lower transformer attachment lug 23 forms a generally vertical oriented plate for being attached to the upper edge of one side of the lower transformer 15.

The lower transformer attachment lug 23 preferably has a plurality of apertures 29 therethrough for allowing fastening means 31, such as bolts, screws or the like, to extend therethrough into coacting lifting means or provisions 33 of the transformer 15, etc., to thereby secure the bracket 11 to the transformer 15 as will now be apparent to those skilled in the art. As clearly shown in the drawings, the lower transformer attachment lug 23 may have four spaced apart apertures 29 therethrough, with the spacing designed to accommodate the typical spacing of at least two lifting means on most standard pad mounted transformers and the like so that each bracket 11 can be secured to at least two lifting means of a transformer.

The bracket 11 preferably includes an upper pallet attachment means 34 for allowing the upper pallet 17 to be attached relative to the upper pallet supporting platform 25. The upper pallet attachment means 34 preferably includes an upper pallet attachment lug 35 for being attached to the upper pallet 17. The upper pallet attachment lug 35 may be in the shape of a generally rectangular plate attached to the upper pallet supporting platform 25 at one edge, preferably via an offset spacer member 37 extending between the upper pallet attachment lug 35 and the junction between the lower transformer attachment lug 23 and the upper pallet supporting platform 25. When the lower transformer attachment lug 23 is attached to a lower transformer 15 supported on a lower pallet 16 resting on a typically horizontal support surface 27 (e.g., the ground, floor, trailer, etc.), the upper pallet attachment lug 35 forms a generally vertical oriented plate for being attached to a lower edge of one side of the upper pallet 17.

The upper pallet attachment lug 35 preferably has a plurality of apertures 39 therethrough for allowing fastening means 41, such as lag bolts, screws or the like, to extend therethrough into a lower edge of one side of the upper pallet 17, etc., to thereby secure the bracket 11 to the upper pallet 17 as will now be apparent to those skilled in the art. As clearly shown in the drawings, the upper pallet attachment lug 35 may have two spaced apart apertures 39 therethrough.

The bracket 11 preferably includes a lower transformer end stop plate 43 for engaging an end portion of the lower transformer 15. The lower transformer end stop plate 43 may be in the shape of a generally rectangular plate attached to one end of both the lower transformer attachment lug 23 and the upper pallet supporting platform 25 in a substantially 90° corner. When the lower transformer attachment lug 23 is attached to a lower transformer 15 supported on a lower pallet 16 resting on a typically horizontal support surface 27 (e.g., the ground, floor, trailer, etc.), the lower transformer end stop plate 43 forms a generally vertical oriented plate for being butted against an end portion of the lower transformer 15 to help properly position the bracket 11 on the lower transformer 15.

The bracket 11 may be constructed in various manners and out of various materials as will now be apparent to those skilled in the art. Preferably, the bracket 11 is cut, bent and welded, or otherwise formed, out of a substantially rigid metal plate in a size to accommodate typical pad mounted transformers, etc. Thus, for example, the lower transformer attachment lug 23 may have a length of approximately 24 inches (60.96 centimeters) and a height of approximately 7 inches (17.78 centimeters), the upper pallet supporting platform 25 may have a length of approximately 24 inches (60.96 centimeters) and a width of approximately 3 inches (7.62 centimeters), and the upper pallet attachment lug 35 may have a length of approximately 10 inches (25.4 centimeters) and a height of approximately 2 inches (5.08 centimeters).

The first preferred embodiment of the shipping/storage package 21 of the present invention is shown in FIGS. 5–8, in combination with the brackets 11, 12. The shipping/storage package 21 includes a lower transformer 15 mounted or supported on a lower pallet 16; an upper transformer 19 mounted or supported on an upper pallet 17; a first or left hand bracket 11 attached to the upper left hand side of the lower transformer 15 via the lower transformer attachment lug 23 and fastening means 31, supporting the lower left hand side of the upper pallet 17 via the upper pallet supporting platform 25, and attached to the lower left hand side of the upper pallet 17 via the upper pallet attachment lug 35 and fastening means 41; and a second or right hand bracket 12 (a, mirror image of the first or left hand bracket 11) attached to the upper right hand side of the lower transformer 15 via a lower transformer attachment lug 23 and fastening means 31, supporting the lower right hand side of the upper pallet 17 via an upper pallet supporting platform 25, and attached to the lower right hand side of the upper pallet 17 via an upper pallet attachment lug 35 and fastening means 41. The shipping/storage package 21 thus allows two or more transformers to be stacked one above the other in piggy back fashion for shipping and storage, allowing the manufacturer and end user to reduce the cost of shipping and storage.

The method of building the shipping/storage package 21 of the present invention includes the steps of (a) providing a first article/pallet unit including a first or lower pallet 16 and a first or lower article or transformer 15 positioned on top of the first pallet 16; (b) providing a second article/pallet unit including a second or upper pallet 17 and a second or upper article or transformer 19 positioned on top of the second pallet 17; (c) providing a first bracket 11 having an article attachment lug 23 and a pallet supporting platform 25; (d) providing a second bracket 12 having an article attachment lug 23 and a pallet supporting platform 25; (e) attaching the article attachment lug 23 of the first bracket 11 to a first or left side of the first article 15; (f) attaching the article attachment lug 23 of the second bracket 12 to a second or right side of the first article 15; (g) supporting a first or left side of the second pallet 17 on the pallet supporting platform 25 of the first bracket 11; and (h) supporting a second or right side of the second pallet 17 on the pallet supporting platform 25 of the second bracket 12. The method preferably includes the steps of attaching the pallet attachment lug 35 of the first bracket 11 to the first or left side of the second pallet 17, and attaching the pallet attachment lug 35 of the second bracket 12 to the second or right side of the second pallet 17. The method also preferably includes the steps of abutting the article end stop plate 43 of the first bracket 11 against an end of the first or left side of the first article 15 prior to attaching the article attachment lug 23 of the first bracket 11 to the first article 15, and abutting the article end stop plate 43 of the second bracket 12 against an end of the second or right side of the first article 15 prior to attaching the article attachment lug 23 of the second bracket 12 to the first article 15. It should be noted that the specific manner in which the above steps can be carried out may vary. Typically, however, a standard fork lift truck or the like will be used to move the first and second article/pallet units and the finished shipping/storage package 21, using the common fork lift provisions of a standard pallet. Thus, with the first article/pallet unit resting on the support surface 27 (i.e., prior to the second article/pallet unit being placed on top thereof), the brackets 11, 12 can easily be attached to the left and right sides, respectively, of the lower transformer 15. Then, the second article/pallet unit can be picked up with a standard fork lift truck and placed on top of the lower transformer 15 with the upper pallet 17 resting on the upper pallet supporting platforms 25 of the brackets 11, 12, thereby supporting the second article/pallet unit on top of the first article/pallet unit in piggy back fashion and forming the shipping/storage package 21. For added support, the upper pallet attachment lugs 35 of the brackets 11, 12 can then be attached to the left and right sides of the upper pallet 17, respectively.

A second preferred embodiment of the present invention, shown in FIGS. 9–16, includes a first or left hand bracket 2.11 and a second or right hand bracket 2.12 attached to opposite sides of the top 2.13 of a lower pad mounted transformer 2.15 mounted on a lower pallet 2.16, to hold an upper pallet 2.17 for supporting an upper pad mounted transformer 2.19 in piggy back fashion over the lower transformer 2.15 and lower pallet 2.16; and includes a shipping/storage package 2.21 formed by using the brackets 2.11, 2.12 to mount the upper pallet 2.17 and upper transformer 2.19 above the lower pallet 2.16 and lower transformer 2.15.

The pallets 2.16, 2.17 may consist of typical plastic pallets on which goods are placed for storage or moving. Such typical plastic pallets may be molded one-piece construction with recesses formed therein for the tines of fork lift trucks or the like, and may serve the dual purpose of a shipping/storage pallet and a mounting pad on which a pad mounted transformer can be installed on the surface of the ground, etc.

Each bracket 2.11, 2.12 is preferably a mirror image of one another, with one (i.e., the bracket 2.11) designed for mounting to the left side of the top 2.13 of the lower transformer 2.15 and with the other (i.e., the bracket 2.12) designed for mounting to the right side of the top 2.13 of the lower transformer 2.15. The following detailed description of the bracket 2.12 will be sufficient to disclose the structure, manufacture and operation of both brackets 2.11, 2.12 to those skilled in the art, with reference numerals to like elements and parts of each bracket 2.11, 2.12 being the same to emphasize the similarity of the two brackets 2.11, 2.12.

The bracket 2.12 includes a lower transformer attachment lug 2.23 for being attached to the lower transformer 2.15, and an upper pallet supporting platform 2.25 for supporting the upper pallet 2.17. Both the lower transformer attachment lug 2.23 and the upper pallet supporting platform 225 may be in the shape of generally rectangular plates attached to one another at one edge in a substantially 90° corner, forming a generally upside down L-shape structural member when viewed in cross section. When the lower transformer attachment lug 2.23 is attached to a lower transformer 2.15 supported on a lower pallet 2.16 resting on a typically horizontal support surface 2.27 (e.g., the ground, floor, trailer, etc.), the upper pallet supporting platform 2.25 forms a generally horizontally oriented plate for supporting one side of the bottom of the upper pallet 2.17 while the lower transformer attachment lug 2.23 forms a generally vertical oriented plate for being attached to the upper edge of one side of the lower transformer 2.15.

The lower transformer attachment lug 2.23 preferably has a plurality of apertures, closed slots, or downwardly opened slots 2.29 therethrough for allowing fastening means 2.31, such as bolts, screws or the like, to extend therethrough into coacting lifting means or provisions 2.33 of the transformer 2.15, etc., to thereby secure the bracket 2.12 to the transformer 2.15 as will now be apparent to those skilled in the art. As clearly shown in the drawings, the lower transformer attachment lug 2.23 preferably has at least two spaced apart slots 2.29 therein, with the spacing designed to accommodate the typical spacing of at least two lifting means on most standard pad mounted transformers and the like so that each bracket 2.12 can be secured to at least two lifting means of a transformer.

The bracket 2.12 preferably includes an upper pallet attachment means 2.34 for allowing the upper pallet 2.17 to be attached relative to the upper pallet supporting platform 2.25. The upper pallet attachment means 2.34 preferably includes one or more closed apertures or slots 2.36 formed in the body of the bracket 2.12 (preferably at the junction between the lower transformer attachment lug 2.23 and the upper pallet supporting platform 2.25 as clearly shown in the drawings) and a typical banding strap 2.37 for passing through each slot 2.36, around the upper pallet 2.17, and around or secured to the upper transformer 2.19.

The bracket 2.12 may include an upper pallet side stop plate 2.39 for engaging a side portion of the upper pallet 2.19. The upper pallet side stop plate 2.39 may be in the shape of a generally rectangular plate attached to the outer side of the upper pallet supporting platform 2.25 in a substantially 90° corner. When the lower transformer attachment lug 2.23 is attached to a lower transformer 15 supported on a lower pallet 2.16 resting on a typically horizontal support surface 2.27 (e.g., the ground, floor, trailer, etc.), the upper pallet side stop plate 2.39 forms a generally vertical oriented plate for being butted against an side portion of the upper pallet 2.17 (see, e.g., FIG. 15) to help properly position the bracket 2.12 with respect to the upper pallet 2.17 and the upper transformer 2.19, etc.

The bracket 2.11 may include an upper pallet end stop plate 2.43 for engaging an end portion of the upper pallet 2.19. The upper pallet end stop plate 2.43 may be in the shape of a generally rectangular plate attached to the rear end of the upper pallet supporting platform 2.25 in a substantially 90° corner. When the lower transformer attachment lug 2.23 is attached to a lower transformer 2.15 supported on a lower pallet 2.16 resting on a typically horizontal support surface 2.27 (e.g., the ground, floor, trailer, etc.), the upper pallet end stop plate 2.43 forms a generally vertical oriented plate for being butted against an end portion of the upper pallet 2.17 (see, e.g., FIG. 16) to help properly position the bracket 2.12 with respect to the upper pallet 2.17 and the upper transformer 2.19, etc.

The bracket 2.12 may be constructed in various manners and out of various materials as will now be apparent to those skilled in the art. Preferably, the bracket 2.12 is cut, bent and welded, or otherwise formed, out of a substantially rigid metal plate in a size to accommodate typical pad mounted transformers, etc. Reinforcing braces, gussets or strengthening ribs of some sort may be provided between the lower transformer attachment lug 2.23 and the upper pallet supporting platform 2.25 to reinforce and strengthen the bracket 2.12 as will now be apparent to those skilled in the art.

Figure 13:
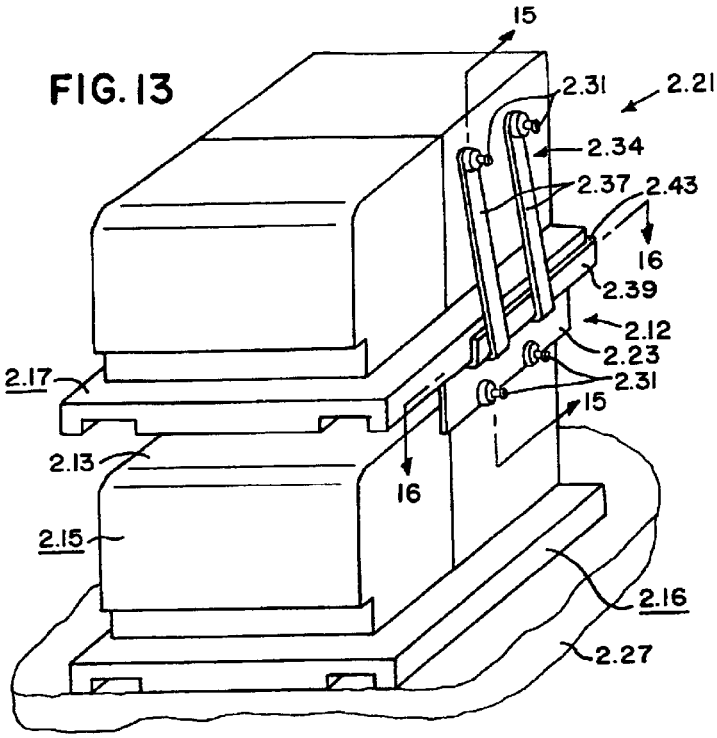
FIG. 13 is a right side perspective view of a shipping/storage package of the present invention, shown in combination with the second embodiment of the bracket of the present invention.
Figure 14:
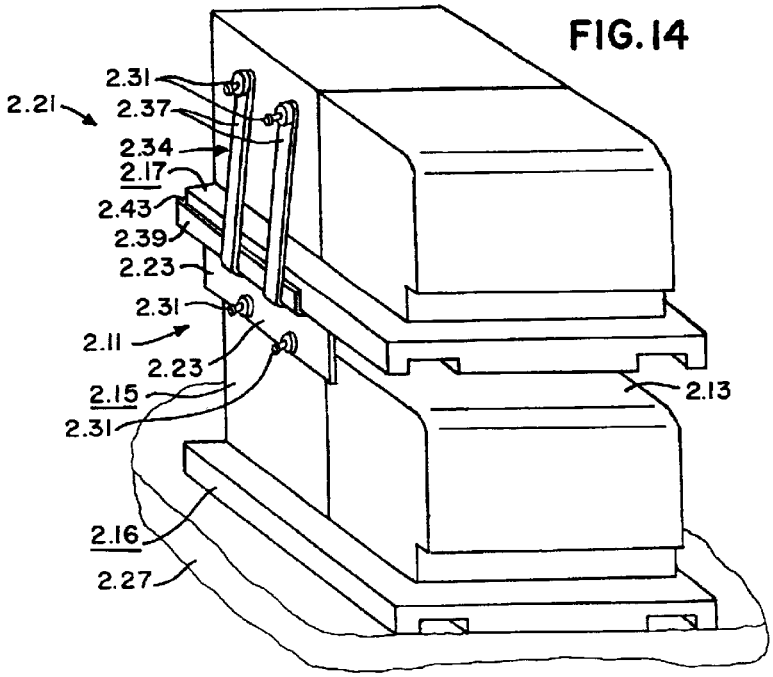
FIG. 14 is a left side perspective view of the shipping/storage package of FIG. 13.
Figure 15:
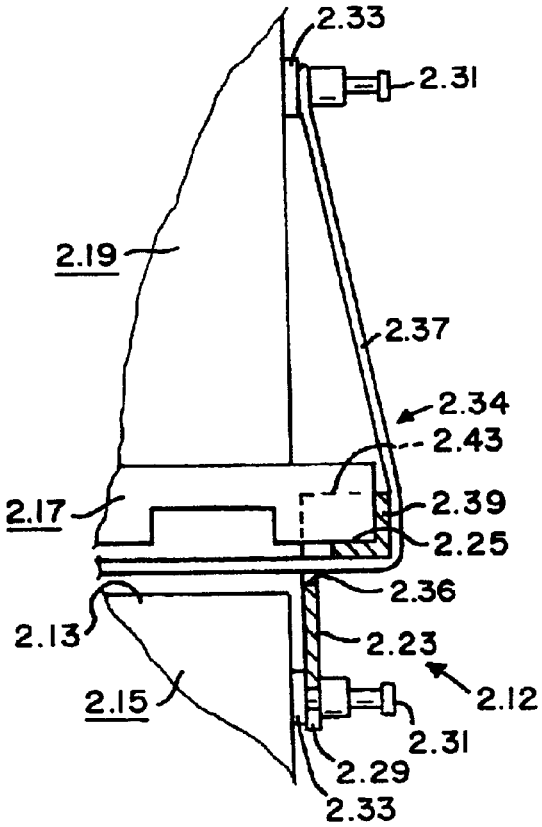
FIG. 15 is a sectional view substantially as taken on line 15—15 of FIG. 13 on an enlarged scale and with portions omitted or broken away for clarity.
Figure 16:
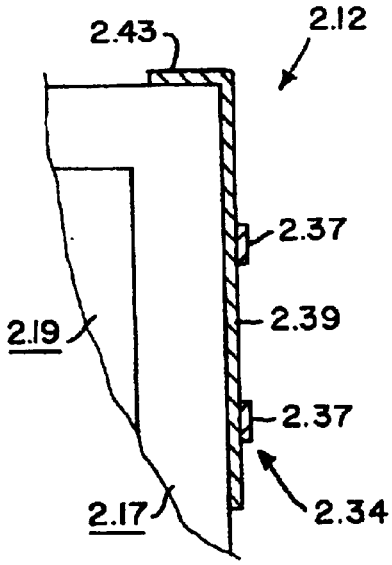
FIG. 16 is a sectional view substantially as taken on line 16—16 of FIG. 13 on an enlarged scale and with portions omitted or broken away for clarity.

The second preferred embodiment of the shipping/storage package 2.21 of the present invention is shown in FIGS. 13–14, in combination with the brackets 2.11, 2.12. The shipping/storage package 2.21 includes a lower transformer 2.15 mounted or supported on a lower pallet 2.16; an upper transformer 2.19 mounted or supported on an upper pallet 2.17; a first or left hand bracket 2.11 (a mirror image of the second or right hand bracket 2.12) attached to the upper left hand side of the lower transformer 2.15 via the lower transformer attachment lug 2.23 and fastening means 2.31, supporting the lower left hand side of the upper pallet 2.17 via the upper pallet supporting platform 2.25; and a second or right hand bracket 2.12 attached to the upper right hand side of the lower transformer 2.15 via a lower transformer attachment lug 2.23 and fastening means 2.31, supporting the lower right hand side of the upper pallet 2.17 via an upper pallet supporting platform 2.25. The shipping/storage package 2.21 thus allows two or more transformers to be stacked one above the other in piggy back fashion for shipping and storage, allowing the manufacturer and end user to reduce the cost of shipping and storage.

The method of building the shipping/storage package 2.21 of the present invention includes the steps of (a) providing a first article/pallet unit including a first or lower pallet 2.16 and a first or lower article or transformer 2.15 positioned on top of the first pallet 2.16; (b) providing a second article/pallet unit including a second or upper pallet 2.17 and a second or upper article or transformer 2.19 positioned on top of the second pallet 2.17; (c) providing a first bracket 2.11 having an article attachment lug 2.23 and a pallet supporting platform 2.25; (d) providing a second bracket 2.12 having an article attachment lug 2.23 and a pallet supporting platform 2.25; (e) attaching the article attachment lug 2.23 of the first bracket 2.11 to a first or left side of the first article 2.15; (f) attaching the article attachment lug 2.23 of the second bracket 2.12 to a second or right side of the first article 2.15; (g) supporting a first or left side of the second pallet 2.17 on the pallet supporting platform 2.25 of the first bracket 2.11; and (h) supporting a second or right side of the second pallet 2.17 on the pallet supporting platform 2.25 of the second bracket 2.12. The method may also include the steps of banding the upper or second article 19 to the upper or second pallet 2.17 and the brackets 2.11, 2.12 with one or more banding straps 2.37 by, for example, extending the ends of each banding strap 2.37 through the slots 2.36 in the brackets 2.11, 2.12, around the bottom of the upper or second pallet 2.13, and to the lifting means 2.33 of the upper or second article 2.19 for being secured to the lifting means 2.33 via the fastening means 2.31, etc. Each end of each banding strap 2.37 may have a loop or the like for encircling a lifting means 2.33. It should be noted that the specific manner in which the above steps can be carried out may vary. Typically, however, a standard fork lift truck or the like will be used to move the first and second article/pallet units and the finished shipping/storage package 2.21, using the common fork lift provisions of a standard pallet. Thus, with the first article/pallet unit resting on the support surface 2.27 (i.e., prior to the second article/pallet unit being placed on top thereof), the brackets 2.11, 2.12 can easily be attached to the left and right sides, respectively, of the lower transformer 2.15. Then, the second article/pallet unit can be picked up with a standard fork lift truck and placed on top of the lower transformer 2.15 with the upper pallet 2.17 resting on the upper pallet supporting platforms 2.25 of the brackets 2.11, 2.12, thereby supporting the second article/pallet unit on top of the first article/pallet unit in piggy back fashion and forming the shipping/storage package 2.21. For added support, the binding straps 2.37 can then be used to secure the upper transformer 2.19 and upper pallet 2.17 to the brackets 2.11, 2.12, etc.

Although the present invention has been described and illustrated with respect to preferred embodiments and preferred uses therefor, it is not to be so limited since modifications and changes can be made therein which are within the full intended scope of the invention.

What is claimed is:

1. A shipping/storage package comprising:

(a) a first pallet:

(b) a first article positioned on top of said fist pallet, said first article having a first side and a second side;

(c) a second pallet, said second pallet having a first side and a second side;

(d) a second article positioned on top of said second pallet;

(e) a first bracket having an article attachment lug attached to said first side of said first article and a pallet supporting platform supporting said first side of said second pallet; said first bracket including a pallet attachment means for attaching said second pallet to said pallet supporting platform of said first bracket; and (f) a second bracket having an article attachment lug attached to said second side of said first article and a pallet supporting platform supporting said second side of said second pallet; said second bracket including a pallet attachment means for attaching said upper pallet to said pallet supporting platform of said second bracket.

2. A method for building a piggy back shipping/storage package comprising the steps of:

(a) providing a first article/pallet unit including a first pallet and a first article positioned on top of said first pallet, said first article having a first side and a second side;

(b) providing a second article/pallet unit including a second pallet and a second article positioned on top of said second pallet, said second pallet having a first side and a second side;

(c) providing a first bracket having an article attachment lug and a pallet supporting platform; said first bracket including a pallet attachment means;

(d) attaching said pallet attachment means of said first bracket to said first side of said second pallet;

(e) providing a second bracket having an article attachment lug and a pallet supporting platform; said second bracket including a pallet attachment lug;

(f) attaching said pallet attachment lug of said second bracket to said second side of said second pallet;

(f) attaching said article attachment lug of said first bracket to said first side of said first article;

(f) attaching said article attachment lug of said second bracket to said second side of said first article;

(g) supporting said first side of said second pallet on said pallet supporting platform of said first bracket; and (h) supporting said second side of said second pallet on said pallet supporting platform of said second bracket.

* * * * *